US009646776B1

(12) United States Patent
Park et al.

(10) Patent No.: US 9,646,776 B1
(45) Date of Patent: May 9, 2017

(54) ON-OFF LEVER OF DISCONNECTING SWITCH FOR POWER DISTRIBUTION LINE

(71) Applicant: DTR CO., LTD., Jinju-si, Gyeongsangnam-do (KR)

(72) Inventors: Choon-hyun Park, Yangsan-si (KR); Dae-hoon Yoo, Busan (KR); Jung-hyun Park, Busan (KR); Ki-chul Park, Yangsan-si (KR)

(73) Assignee: DTR Electric Corporation (KR)

( * ) Notice: Subject to any disclaimer, the term of this patent is extended or adjusted under 35 U.S.C. 154(b) by 0 days.

(21) Appl. No.: 15/000,328

(22) Filed: Jan. 19, 2016

(30) Foreign Application Priority Data

Dec. 9, 2015 (KR) ..... 10-2015-0175188

(51) Int. Cl.
*H01H 15/24* (2006.01)
*H01H 3/04* (2006.01)
*H01H 9/24* (2006.01)

(52) U.S. Cl.
CPC ..... *H01H 3/04* (2013.01); *H01H 9/24* (2013.01)

(58) Field of Classification Search
CPC ..... H01H 3/04; H01H 9/24
USPC ..... 200/538, 48 R, 48 P, 48 A, 49, 61.58 R, 200/61.85, 50.01, 50.02, 50.11
See application file for complete search history.

(56) References Cited

U.S. PATENT DOCUMENTS 4,049,936 A * 9/1977 Frink ..... H01H 3/30 200/48 R
4,107,486 A * 8/1978 Evans ..... H01H 3/227 200/48 R
4,136,372 A * 1/1979 Oak ..... H02B 1/14 174/5 R

FOREIGN PATENT DOCUMENTS

| | | | |
|---|---|---|---|
| EP | 0632540 | A2 | 1/1995 |
| KR | 10-2000-0021792 | A | 4/2000 |
| KR | 20-0272726 | Y1 | 4/2002 |
| KR | 20-0339332 | Y1 | 1/2004 |
| KR | 10-1503781 | B1 | 3/2015 |
| KR | 10-1556570 | B1 | 10/2015 |

OTHER PUBLICATIONS

International Search Report(PCT/KR2015/014320), WIPO, Aug. 30, 2016.

* cited by examiner

*Primary Examiner* — Edwin A. Leon
(74) *Attorney, Agent, or Firm* — Park & Associates IP Law, P.C.

(57) ABSTRACT

The present invention relates to an on-off lever of a disconnecting switch for a power distribution line that can connect or disconnect lines through easy and safe manipulation of the on-off lever. According to an embodiment of the present invention, the on-off lever of the disconnecting switch for the power distribution line, the on-off lever having: a lever body mounted to an end part of a movable member; a shaft hole formed on a first portion of a middle part of the lever body; a locking step provided on a lower part of the lever (Continued)

body such that the locking step is locked to a locking end; a guide hole formed on a second portion of the middle part of the lever body; and a manipulation means provided on an upper part of the lever body.

7 Claims, 4 Drawing Sheets

ON-OFF LEVER OF DISCONNECTING SWITCH FOR POWER DISTRIBUTION LINE

REFERENCE TO RELATED APPLICATIONS

This application claims the priority benefit of Korean Patent Application No. 10-2015-0175188 filed on Dec. 9, 2015, the entire contents of which are incorporated herein by reference.

FIELD OF THE INVENTION

The present invention generally relates to an on-off lever of a disconnecting switch for a power distribution line that connects or disconnects lines by being mounted on one of the lines. More particularly, the present invention relates to an on-off lever of a disconnecting switch for a power distribution line that can connect or disconnect lines through easy and safe manipulation of the on-off lever.

BACKGROUND OF THE INVENTION

Generally, a disconnecting switch for a power distribution line is a device for connecting or disconnecting lines at a condition near zero voltage or zero current by being mounted on one of the lines.

The disconnecting switch for the power distribution line includes: a first terminal connected to a first line; a second terminal connected to a second line; a movable member rotatably mounted to the first terminal; a fixed member mounted to the second terminal; an on-off lever rotatably mounted to an end part of the movable member; and a locking end mounted to an end part of the fixed member.

That is, the on-off lever of the disconnecting switch for the power distribution line is locked to or released from the locking end of the fixed member by rotating the movable member in a first direction or a second direction, thereby connecting or disconnecting the first line and the second line.

Here, the on-off lever includes: a lever body; a shaft hole provided on the lever body, the shaft hole supporting a support shaft such that the lever body elastically rotates on the movable member; a manipulation hole formed at a first portion of the lever body so as to rotate the lever body in the first direction; and a locking step provided on a second portion of the lever body such that the locking step is locked to the locking end.

Accordingly, when connecting lines, the movable member is rotated toward the fixed member after inserting a tool into the manipulation hole for manipulation of the on-off lever, and then the locking step hits the locking end. Then, after the lever body is rotated in the first direction by the collision of the locking step with the locking end, the lever body is restored to an original position, and the locking step is locked to the locking end. Accordingly, the movable member is locked to the fixed member, and thus the lines are connected to each other. Further, when disconnecting the lines, the movable member is rotated in a direction contrary to a location of the fixed member while rotating the lever body in the first direction after inserting the tool into the manipulation hole, and then the locking step is released from the locking end. Accordingly, the movable member is released from the fixed member, and thus the lines are disconnected from each other.

However, since when connecting the lines as mentioned above, the movable member is required to be forcefully rotated toward the fixed member such that the locking step is locked to the locking end while the lever body is rotating, it is difficult to connect the lines, and further, poor manipulation of the on-off lever of the disconnecting switch for the power distribution line may cause electric shock accidents.

In addition, while forcefully rotating the movable member, the locking step and the locking end strongly hits together. Accordingly, the locking step and the locking end may be broken due to the hitting and thereby connecting or disconnecting the lines may not be performed and further a lifespan of the on-off lever is also shortened.

The foregoing is intended merely to aid in the understanding of the background of the present invention, and is not intended to mean that the present invention falls within the purview of the related art that is already known to those skilled in the art.

SUMMARY OF THE INVENTION

Accordingly, the present invention has been made keeping in mind the above problems occurring in the related art, and the present invention is intended to propose an on-off lever of a disconnecting switch for a power distribution line, wherein the on-off lever is easily and safely manipulated, thereby preventing the disconnecting switch from being damaged or broken, and enabling an efficient connecting or disconnecting operation of the disconnecting switch.

The object of the present invention is not limited to the above-mentioned object, and other purposes that were not mentioned will be clearly appreciated referring to details described below.

In order to achieve the above object, according to one aspect of the present invention, there is provided an on-off lever of a disconnecting switch for a power distribution line, the on-off lever including: a lever body mounted to an end part of a movable member, the lever body being elastically supported by an elastic member; a shaft hole formed on a first portion of a middle part of the lever body, wherein a support shaft mounted to the movable member is inserted into the shaft hole, thereby allowing the lever body to rotate; a locking step provided on a lower part of the lever body such that the locking step is locked to a locking end; a guide hole formed on a second portion of the middle part of the lever body, wherein a guide shaft mounted to the movable member restricts a rotation angle of the lever body to a predetermined angle by being inserted into the guide hole, with a gap defined between the guide shaft and the guide hole; and a manipulation means provided on an upper part of the lever body, the manipulation means rotating the lever body such that the locking step is locked to or released from the locking end, wherein the on-off lever mounted to the end part of the movable member connected to a first line connects or disconnects the first line and a second line while being locked to or released from the locking end of a fixed member connected to the second line according to rotation of the movable member.

The guide hole may restrict the rotation angle of the lever body from a first angle at which the locking step is locked to the locking end to a second angle at which the locking step is released from the locking end.

The guide hole may be a circular hole having a diameter larger than a diameter of the guide shaft.

The guide hole may be a longitudinal hole formed along a radius of rotation of the lever body.

The manipulation means may include a manipulation hole provided on the upper part of the lever body.

The manipulation hole may include: a first manipulation hole provided on a first portion of the upper part of the lever body; and a second manipulation hole provided on a second portion of the upper part of the lever body.

The first manipulation hole may be open on an end thereof.

According to the present invention having the above-mentioned configuration, since the movable member is easily connected to or separated from the fixed member without having impact produced between the locking step of the on-off lever and the locking end of the fixed member by rotation of the lever body of the on-off lever of the disconnecting switch for the power distribution line, electric shock accidents that may occur during manipulation through which the disconnecting switch connects or disconnects lines can be prevented, and further, the disconnecting switch can be prevented from being damaged or broken, which increases the connecting or disconnecting reliability of the disconnecting switch.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
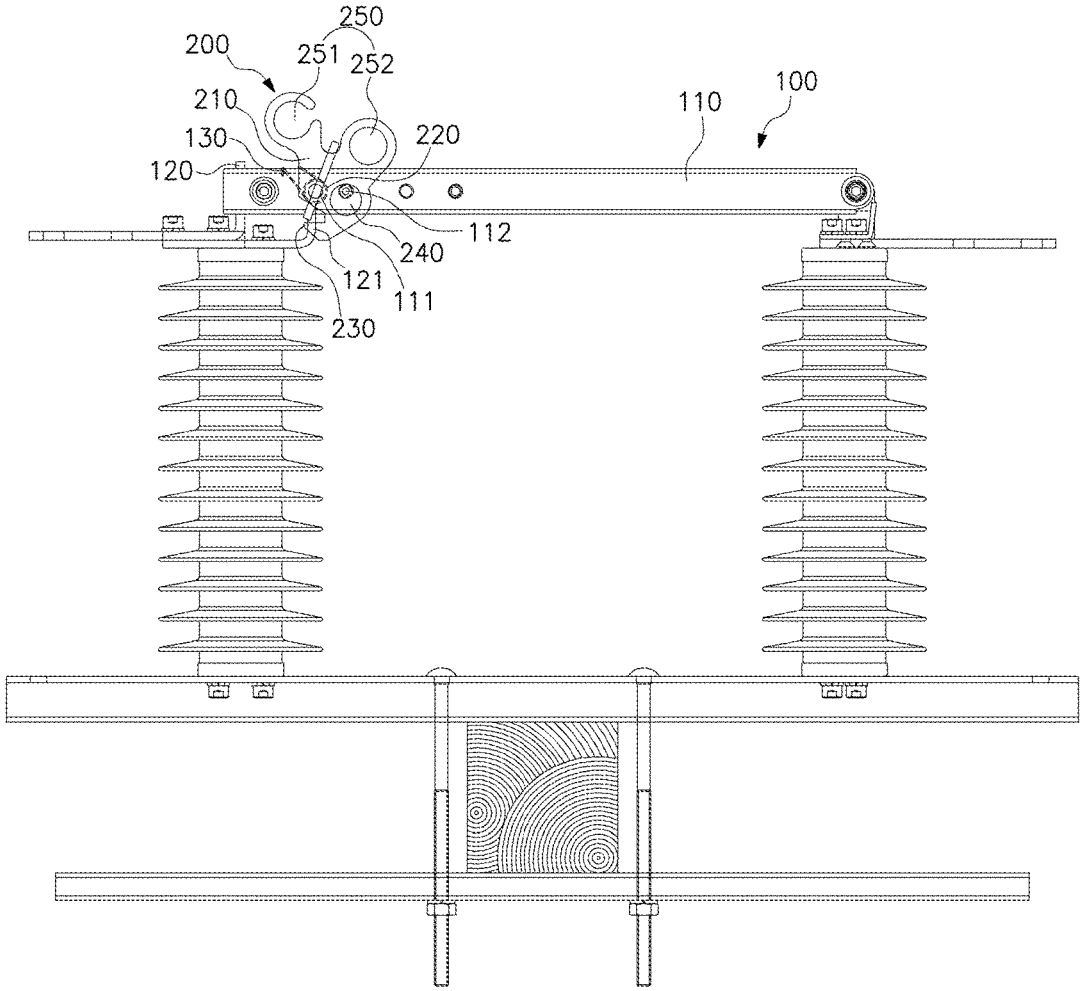
FIG. 1 is a side view showing a closed state of a disconnecting switch for a power distribution line according to an embodiment of the present invention.

Herein below, an exemplary embodiment of the present invention will be described in detail with reference to the accompanying drawings. Throughout the drawings, the same reference numerals will refer to the same or like parts.

The present invention relates to an on-off lever of a disconnecting switch for a power distribution line for connecting or disconnecting two lines at a condition near zero voltage or zero current by being mounted on one of the lines.

Particularly, according to the embodiment of the present invention, since the on-off lever of the disconnecting switch for the power distribution line can be easily and safely manipulated, electric shock accidents that may occur due to manipulation through which the disconnecting switch connects or disconnects the lines can be prevented, and further, the disconnecting switch can be prevented from being damaged or broken, which increases the connecting or disconnecting reliability of the disconnecting switch.

The above-mentioned object is realized by a configuration of the on-off lever of the disconnecting switch for the power distribution line including: a lever; a shaft hole formed on a first portion of a middle part of a lever body, wherein a support shaft mounted to the movable member is inserted into the shaft hole, thereby allowing the lever body to rotate; a locking step provided on a lower part of the lever body; a guide hole formed on a second portion of the middle part of the lever body, wherein the guide hole is a longitudinal hole or a large hole; and a manipulation means provided on an upper part of the lever body.

Accordingly, when rotating the lever body by using the manipulation means, a gap defined between the guide hole and a guide shaft allows the lever body to rotate relative to the shaft hole in such a manner that the locking step is locked to or released from a locking end. Accordingly, the locking step can be easily locked to or released from the locking end by rotating the lever body, and thus the on-off lever of the disconnecting switch for the power distribution line can be easily and safely manipulated.

Hereinafter, according to the exemplary embodiment of the present invention, the on-off lever of the disconnecting switch for the power distribution line will be described in detail referring to the accompanying drawings.

According to the exemplary embodiment of the present invention, the disconnecting switch 100 for the power distribution line includes the on-off lever 200 of the disconnecting switch for the power distribution line, wherein the on-off lever 200 mounted to an end part of a movable member 110 connected to a first line connects or disconnects the first line and a second line while being locked to or released from the locking end 121 of a fixed member 120 connected to the second line by rotation of the movable member 110. As shown in FIG. 1, the on-off lever 200 may include: the lever body 210; the shaft hole 220; the locking step 230; the guide hole 240; and a manipulation hole 250.

First, the lever body 210 constitutes a body of the on-off lever 200.

To achieve the above object, as shown in FIG. 1, the lever body 210 is rotatably mounted to the end part of the movable member 110.

Furthermore, the lever body 210 is mounted to the end part of the movable member 110, with the lever body 210 elastically supported by an elastic member 130 such that the lever body 210 rotates in a first direction by applying pressure to the movable member 110, and then the lever body 210 is restored to an original position by releasing the pressure.

Next, the shaft hole 220 is configured to support the lever body 210 such that the lever body 210 rotates on the movable member 110.

That is, as shown in FIG. 1, the shaft hole 220 is formed on a first portion of a middle part of the lever body 210 wherein the support shaft 111 mounted to the movable member 110 is inserted into the shaft hole 220.

Accordingly, the lever body 210 is made possible to rotate relative to the support shaft 111 inserted into the shaft hole 220.

Next, the locking step 230 is configured such that the lever body 210 is locked to the locking end 121 of the fixed member 120.

That is, as shown in FIG. 1, the locking step 230 is provided on a lower part of the lever body 210 such that the locking step 230 is locked to or released from the locking end 121 of the fixed member 120 according to a rotation angle of the lever body 210.

Accordingly, while the lever body 210 is rotated in the first direction, the locking step 230 is released from the locking end 121, and when the lever body 210 is elastically restored in a second direction with the movable member 110 being in contact with the fixed member 120, the locking step 230 is locked to the locking end 121.

Next, the guide hole 240 restricts the rotation angle of the lever body 210 to a predetermined angle when the lever body 210 rotates in the first direction relative to the support shaft 111.

To achieve the above object, as shown in FIG. 1, the guide shaft 112 mounted to the movable member 110 is inserted into the guide hole 240, with the gap defined between the guide hole 240 and the guide shaft 112, and the gap restricts the rotation angle of the lever body 210 to the predetermined angle.

In this case, it is preferred that the rotation angle of the lever body 210 is restricted from a first angle at which the locking step 230 is locked to the locking end 121 to a second angle at which the locking step 230 is released from the locking end 121 by rotating the lever body 210 in the first direction.

That is, when the lever body 210 is located at the first angle of an original position, the locking step 230 is locked to the locking end 121, and the movable member 110 is connected to the fixed member 120, whereas when the lever body 210 is located at the second angle by rotating the lever body 210 in the first direction, the locking step 230 is released from the locking end 121, and thus the movable member 110 is separated from the fixed member 120.

Meanwhile, the guide hole 240 may be a circular hole having a diameter larger than a diameter of the guide shaft 112, and though not shown in the drawings, the guide hole 240 may be a longitudinal hole formed along a radius of rotation of the lever body 210 depending on the rotation angle of the lever body 210.

That is, when the gap defined between the guide shaft 112 and the guide hole 240, with the guide shaft 112 inserted into the guide hole 240, can restrict the rotation angle of the lever body 210, the guide hole 240 may be any type of hole.

Lastly, the manipulation means is configured to freely rotate the lever body 210 such that the locking step 230 is locked to or released from the locking end 121.

To achieve the above object, as shown in FIG. 1, the manipulation means is provided on an upper part of the lever body 210, and the manipulation means can rotate the lever body 210 such that the locking step 230 is locked to or released from the locking end 121.

In this case, according to the embodiment of the present invention, as shown in FIG. 1, the manipulation means may include the manipulation hole 250 provided on the upper part of the lever body 210. Further, the manipulation hole 250 may include: a first manipulation hole 251 provided on a first portion of the upper part of the lever body 210; and a second manipulation hole 252 provided on a second portion of the upper part of the lever body 210.

In addition, the first manipulation hole 251 may be open on an end thereof so as to distinguish the first manipulation hole 251 from the second manipulation hole 252. That is, the first manipulation hole 251 and the second manipulation hole 252 are configured such that the first manipulation hole 251 has a shape of "C" that is a first letter of "Close", an English word, and the second manipulation hole 252 has a shape of "O" that is a first letter of "Open", an English word.

Figure 2:
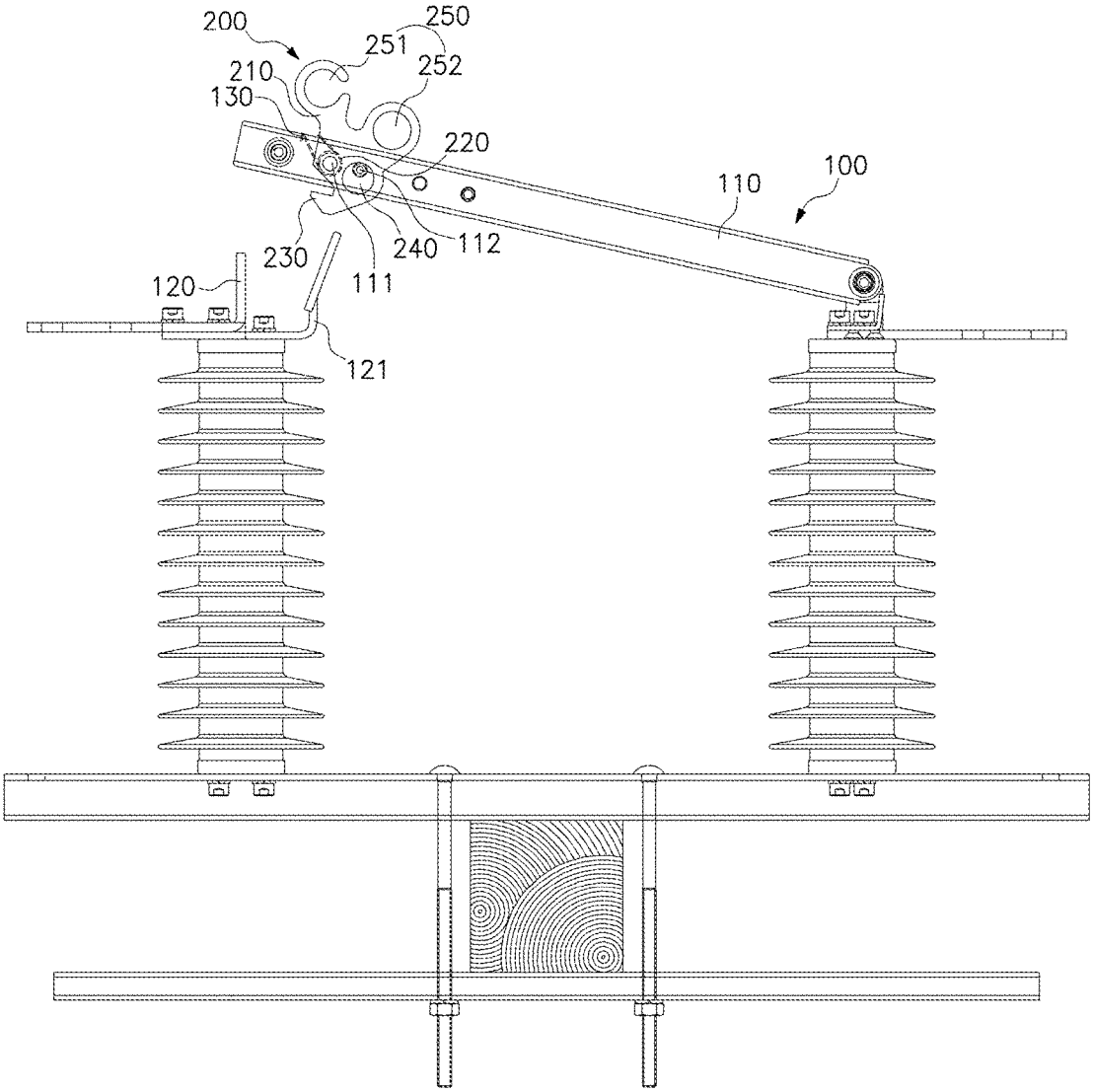
FIG. 2 is a side view showing an open state of the disconnecting switch for the power distribution line according to the embodiment of the present invention.
Figure 3:
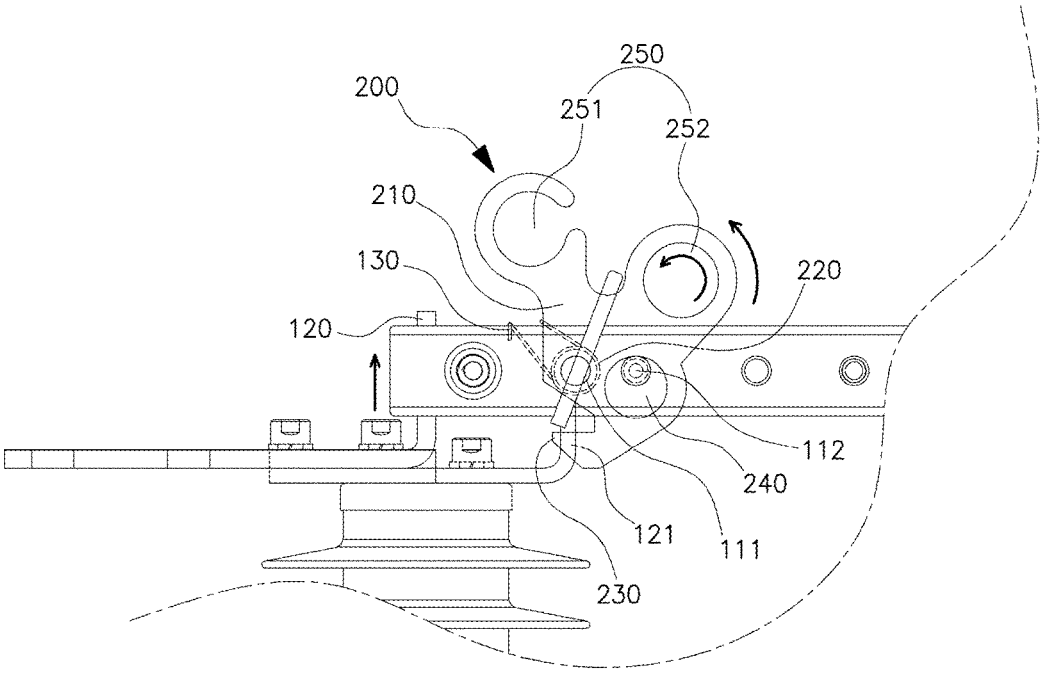
FIG. 3 is a view showing manipulation for realizing the open state of the disconnecting switch for the power distribution line according to the embodiment of the present invention.

Accordingly, as shown in FIG. 3, to separate the movable member 110 from the fixed member 120 when the locking step 230 is locked to the locking end 121 with the movable member 110 being in close contact with the fixed member 120, it is required to rotate the lever body 210 in the first direction that is a direction of an arrow by using the second manipulation hole 252, and then it is required to rotate the movable member 110 in a direction going away from an end part of the fixed member 120 that is a direction of another arrow. Then, as shown in FIG. 2, the locking step 230 is released from the locking end 121, and thus the movable member 110 can be easily separated from the fixed member 120.

Figure 4:
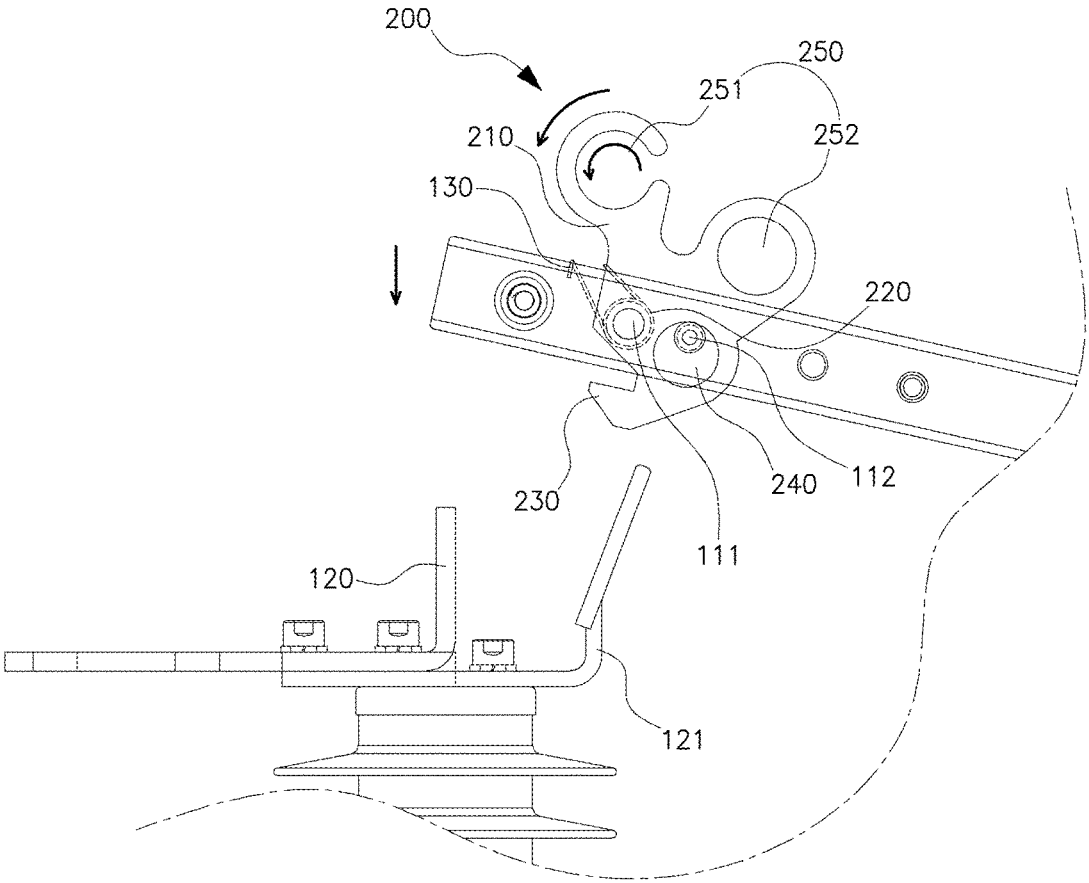
FIG. 4 is a view showing manipulation for realizing the closed state of the disconnecting switch for the power distribution line according to the embodiment of the present invention.

Contrary to what was mentioned above, to connect the movable member 110 to the fixed member 120 after the movable member 110 is separated from the fixed member 120 as shown in FIG. 4, it is required to rotate the lever body 210 in the first direction that is a direction of an arrow by using the first manipulation hole 251 such that the locking step 23 is not interrupted by the locking end 121, and then it is required to rotate the movable member 110 toward the end part of the fixed member 120 that is a direction of another arrow. Then, as shown in FIG. 1, the locking step 230 is locked to the locking end 121, and thus the movable member 110 can be easily connected to the fixed member 120.

As mentioned above, according to the embodiment of the present invention, since the movable member is easily connected to or separated from the fixed member without having impact produced between the locking step of the on-off lever and the locking end of the fixed member by rotation of the lever body of the on-off lever of the disconnecting switch for the power distribution line, electric shock accidents that may occur due to manipulation through which the disconnecting switch connects or disconnects lines can be prevented, and further the disconnecting switch can be prevented from being damaged or broken, which increases the connecting or disconnecting reliability of the disconnecting switch.

Although the preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An on-off lever of a disconnecting switch for a power distribution line, the on-off lever comprising:

a lever body mounted to an end part of a movable member, the lever body being elastically supported by an elastic member;

a shaft hole formed on a first portion of a middle part of the lever body, wherein a support shaft mounted to the movable member is inserted into the shaft hole, thereby allowing the lever body to rotate;

a locking step provided on a lower part of the lever body such that the locking step is locked to a locking end;

a guide hole formed on a second portion of the middle part of the lever body, wherein a guide shaft mounted to the movable member restricts a rotation angle of the lever body to a predetermined angle by being inserted into the guide hole, with a gap defined between the guide shaft and the guide hole; and a manipulation means provided on an upper part of the lever body, the manipulation means rotating the lever body such that the locking step is locked to or released from the locking end, wherein the on-off lever mounted to the end part of the movable member connected to a first line connects or disconnects the first line and a second line while being locked to or released from the locking end of a fixed member connected to the second line according to rotation of the movable member.

2. The on-off lever of claim 1, wherein the guide hole restricts the rotation angle of the lever body from a first angle at which the locking step is locked to the locking end to a second angle at which the locking step is released from the locking end.

3. The on-off lever of claim 1, wherein the guide hole is a circular hole having a diameter larger than a diameter of the guide shaft.

4. The on-off lever of claim 1, wherein the guide hole is a longitudinal hole formed along a radius of rotation of the lever body.

5. The on-off lever of claim 1, wherein the manipulation means comprises a manipulation hole provided on the upper part of the lever body.

6. The on-off lever of claim 5, wherein the manipulation hole comprises:

a first manipulation hole provided on a first portion of the upper part of the lever body; and a second manipulation hole provided on a second portion of the upper part of the lever body.

7. The on-off lever of claim 6, wherein the first manipulation hole is open on an end thereof.

* * * * *